United States Patent [19]

Nold

[11] 4,260,097

[45] Apr. 7, 1981

[54] CONTAINER

[75] Inventor: Richard P. Nold, Gross-Gerau, Fed. Rep. of Germany

[73] Assignee: Real-Pack Entwicklungs-und Verpackungstechnik GmbH, Gross-Gerau, Fed. Rep. of Germany

[21] Appl. No.: 131,361

[22] Filed: Mar. 18, 1980

[30] Foreign Application Priority Data

Mar. 24, 1979 [EP] European Pat. Off. ..... 79100899.8
Mar. 30, 1979 [DE] Fed. Rep. of Germany ..... 2912737

[51] Int. Cl.[3] ..... B65D 5/36; B65D 5/00

[52] U.S. Cl. ..... 229/16 R; 229/22; 229/8; 229/38

[58] Field of Search ..... 229/16 R, 16 A, 16 B, 229/22, 8, 38

[56] References Cited

U.S. PATENT DOCUMENTS

| | | | |
|---|---|---|---|
| 1,431,730 | 10/1922 | Gearson | 229/22 |
| 3,079,062 | 2/1963 | Craddock et al. | 229/16 R |
| 3,302,845 | 2/1967 | Gould | 229/16 R |
| 3,369,727 | 2/1968 | Wright | 229/16 R |
| 3,558,034 | 1/1971 | Benachi | 229/8 |
| 4,063,679 | 12/1977 | Henry | 229/16 R X |
| 4,191,324 | 3/1980 | Kitagawa | 229/22 |

*Primary Examiner*—Davis T. Moorhead
*Attorney, Agent, or Firm*—Michael J. Striker

[57] ABSTRACT

A container formed from a one-piece blank of sheet material by folding parts of the blank relative to each other. The container is closed by adhering a glue flap provided on one of its sidewalls, to another opposite sidewall.

15 Claims, 13 Drawing Figures

CONTAINER

BACKGROUND OF THE INVENTION

The present invention relates to a container made from a one-piece blank of pulpboard, cardboard, synthetic plastic or the like. More particularly the invention relates to a folded box comprising an elongate main body forming the side walls of the container and formed from the blank by connecting two opposite longitudinal flanges of the blank, a quadrangular end wall at one container end from which the side walls converge towards a narrow container closure at the opposite container end, one main folding line each extending from each of two diametrically opposed corners of the end wall rectilinearly towards a point of intersection at the narrow container closure, while minor fold lines extend from the two other diametrically opposed corners of the end wall.

In such known containers (German Published Application DE-OS No. 2 509 052) two minor fold lines extend similarly rectilinearly from any single corner of the end wall to the two ends of the narrow container closure. The container thus formed comprises totally plane side walls which is very convenient when jointly packing several such containers in a surrounding carton or the like, since such containers are in flush contact with one another along all contact surfaces so that no voids are formed between the containers. However, for the utilization of the internal volume of the container for packaging purposes it is sometimes less desirable that the side walls (in the region of the narrow container closure) should converge as completely plane surfaces at an angle which is usually highly acute, since as a result the interior of the container at that end thereof is available for packaging purposes only to a small extent or else not at all.

A preferred field of application of such containers designed as folded boxes is for the packing of tubes. However, at their folded-up end such tubes are not outlined by two planar surfaces either, but comprise a slight outward bulge. Accordingly, the tubes cannot fill the container interior for its full length. They must stop short at a greater or lesser distance from the narrow container closure.

It is also known (German Published Application DE-OS No. 1 807 670) in the context of a similar container for packing tubes to let one minor fold each, starting from the respective corner of the end wall, terminate as early as in the first one-third of the container length, without any further folding line proceeding to each end of the narrow container closure. However, for the major part of the container length this results in an indefinitely convex shape of the side wall whereby the appearance, the stackability when jointly packing several containers and the adaptation of the container interior to the shape of a tube is impaired.

Advantages would arise from a better utilization of the container interior, in particular in the region of the narrow container closure, while substantially retaining the advantages of the aforementioned containers.

SUMMARY OF THE INVENTION

It is, therefore, an object of the invention to provide such advantages and to overcome the prior-art disadvantages.

In accordance with the invention a container is provided of the type in question, wherein from each of the minor fold lines further fold lines which are at an angle to the former proceed to the points of intersection of the main fold lines with the narrow container closure. This results in the container dimensions, and thus also in the container interior in the region of the narrow container closure, being enlarged so that certain objects to be packed, such as tubes, will fit better into the container, permitting a shorter container to be selected for the packaging of the tube or the like. Also, for example in the context of packaging coarsely particulate loose material, a better utilization of the container is attained since the individual particles of the loose material can advance further towards the narrow container closure.

These measures will also meet the objection that the prior art container, as a result of its comparatively great length dictated by the narrow tapering shape, deceptively suggests more content than is actually present.

An additional problem encountered with prior-art containers is that the bonding strip or lug has a width which is uniform over the entire container length, whereas a fold extends at an acute angle into the opposite edge to which the lug is to be bonded, since this edge is a part of one of the triangular sidewalls. The bonding lug which is adhered to the inner side of the container, prevents in this region the desired folding of the edge along the fold line. On the other hand, if the bonding lug is so cut in this region that it does not extend beyond the adjacent folding edge, the connection of the two edges is impaired because the bonding lug would then have to taper so strongly towards one container end that no bonding could take place at that end.

The invention avoids this problem by having the lug interrupted by a fold line corresponding to the fold line formed in the opposite edge, and in that the margin of the lug is released for folding by a cut forming an extension of the fold-line in the lug and by another cut extending at an angle to the first cut.

The section of the lug which is divided off by the fold-line can be readily folded on erection of the container to which glue has been applied, so that folding can proceed without hindrance even in those areas in which the lug is bonded to the inner side. Since the fold-line which interrupts the lug will generally extend at a very acute angle relative to the margin of the lug, in accommodation to the folding line in the opposite edge, there is a danger that the part of the lug which is to be folded might in this area press into the container wall and create a bulge visible at the exterior and/or might interfere with the folding. It is for this reason that the lug portion which is divided off by the lug fold-line is cut away by the two mutually inclined cuts.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
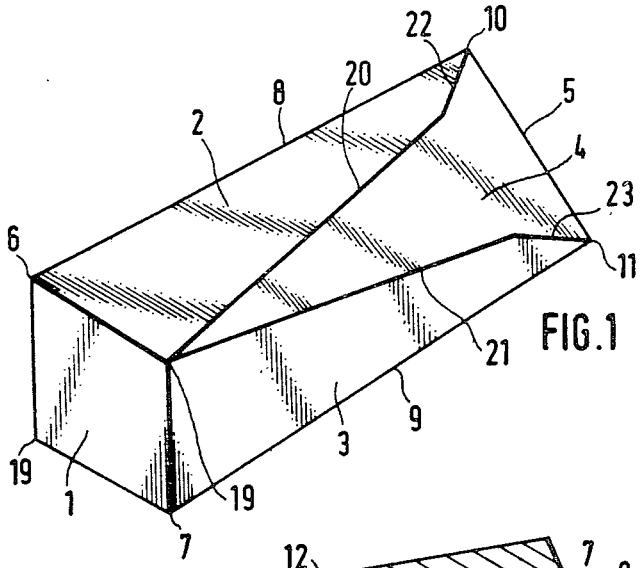
FIG. 1 shows a container in accordance with the invention in the form of a folded box in a perspective view.

The folded box of pulpboard, cardboard, plastics or the like illustrated in FIG. 1 comprises a square endwall 1 and a main body formed by side walls 2, 3 and 4, in each of the figures only the foremost side walls being visible. From the end wall 1 the side walls 2, 3, 4 converge towards a narrow container closure 5 at the opposite container end.

The two corners of the narrow container closure 5 each form one point of intersection 10 and 11 respectively with one each of the main fold lines 8 and 9 respectively which proceed rectilinearly from two diametrically opposed corners 6, 7 of the end wall 1.

Figure 2:
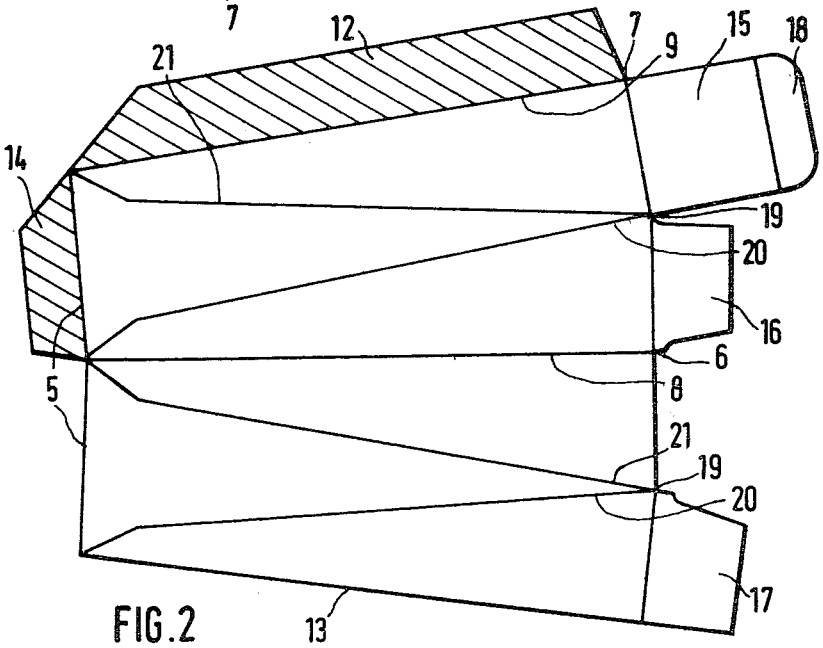
FIG. 2 shows a blank for the container according to FIG. 1.

As will be apparent from the illustration of the blank in FIG. 2, a glue flap 12, the gluing surface of which is shaded in FIG. 2 is hinged on along the main fold line 9. This glue flap 12 is to be connected to the opposite edge of the flap such that the body of the folded box is formed. The narrow container closure 5 similarly comprises a hinged glue flap 14 which forms the closure of the container at the one end.

At the opposite end of the container a flap closure is provided in the manner which is conventional for folded boxes, comprising a hinged-on closure flap 15, side flaps 16, 17 and a closure flap 18 connected to the closure flap 15. It is possible to provide any alternative container closure to form the quadrangular end wall 1. In the illustrated working example the quadrangular end wall is square; however, it stands to reason that the end wall 1 may also be rectangular or in the form of a parallelogram or any other form of quadrangle.

Figure 3:
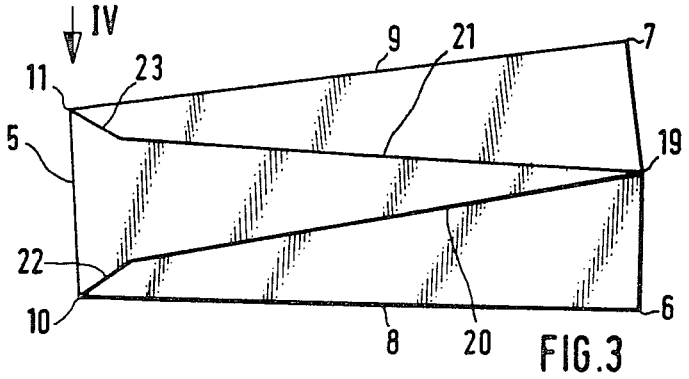
FIG. 3 is a side elevation of the container body pasted together from the blank according to FIG. 2 and lying flat, the closure flaps for the container end comprising the end wall having been omitted.

In the working example illustrated in FIGS. 1–3 two straight minor fold lines 20, 21 proceed from each of the two diametrically opposite corners 19 of the end wall 1 and terminate short of the container closure 5.

Figure 4:
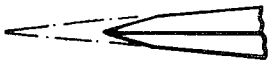
FIG. 4 is a partial elevation in the direction of the arrow IV in FIG. 3 in the upright position.

FIG. 4 illustrates in a partial elevation in the direction of the arrow IV in FIG. 3 the blunted configuration in the region of the narrow container closure 5 which is to be contrasted against a rectilinear continuation of the longitudinal edges of the container illustrated in FIG. 4 by dash-dotted lines.

In the embodiment according to FIG. 5 once again two minor fold lines 20, 21 each proceed from each corner 19 of the end wall 1, each one merging into a fold line 24 and 25 respectively proceeding in the outward direction towards one of the points of intersection 10 or 11 respectively. Here as well the angle between the minor fold lines 20 and 21 is smaller than the angle which would result from a rectilinear extension towards the points of intersection 10 and 11 respectively. However, in contrast to the embodiment according to FIGS. 1 to 3, the fold lines 24, 25 are not rectilinear and at an angle to the minor fold lines 20, 21, but follow an arcuate pattern, for example along a circular path towards the intersection points 10, 11.

Figure 5:
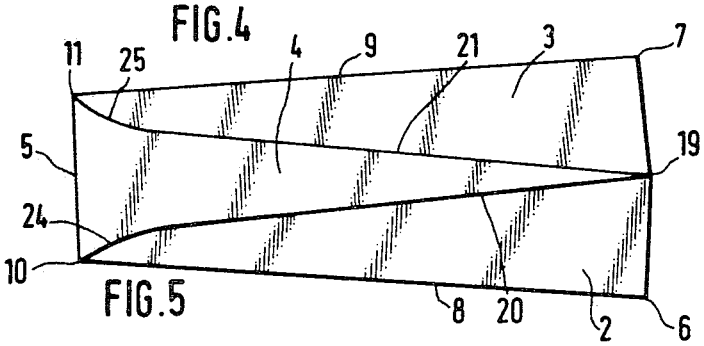
FIG. 5 shows a modified embodiment in a view similar to FIG. 3.
Figure 6:
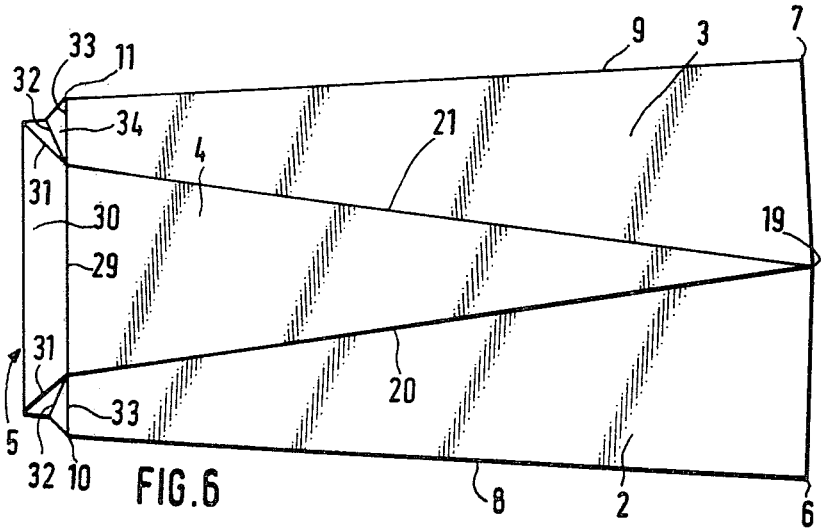
FIG. 6 is a view similar to FIG. 3 but showing another embodiment.
Figure 6A:
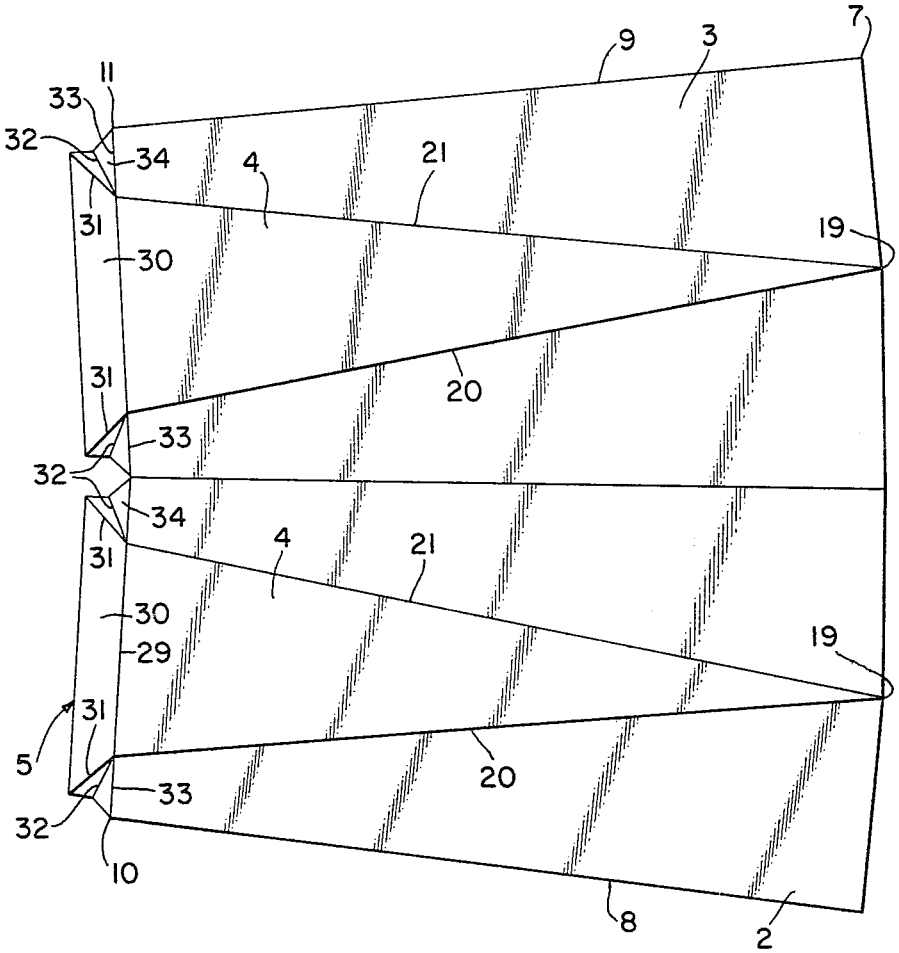
FIG. 6*a* is a plan view of the blank from which the container of FIG. 6 is erected.

In the embodiment according to FIGS. 6 (container) and 6*a* (blank) in a manner similar to the example according to FIG. 5, two minor fold lines 20, 21 proceed from each corner 19 and each have their ends connected at the container end by a flange-forming fold line 29, where a narrow closure flange 30 is connected. The two closure flanges 30 thus formed can be foldably interconnected by a pasting flange (not illustrated) in order to form a narrow container closure wall. From each of the ends of the minor fold lines 20 and 21 three short fold lines 31, 32 and 33 proceed, between which a collapsible gusset is formed which interconnects the closure flap 30 to the adjoining container side wall 2 and 3 respectively. In the erected state of the container the fold lines 31 and 33 adjoin one another. The fold lines 33 proceed at an angle from the minor fold lines 20, 21 to the intersection points 10, 11 of the main fold line 8, 9 with the container closure 5.

Figure 7:
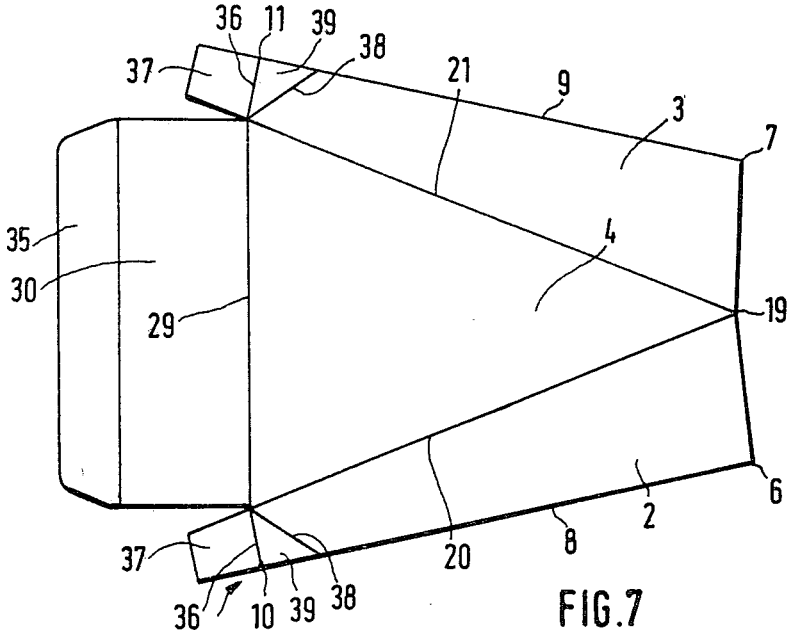
FIG. 7 is another view similar to FIG. 3 but showing still a further embodiment.

In analogy with the example according to FIG. 6, the working example according to FIG. 7 again provides for two minor fold lines 20, 21 to proceed from each corner 19 and to be interconnected in the region of the opposite container end by a flap forming fold line 29 along which a narrow closure flap 30 is connected which is foldably connected to a closure flap 35. The ends of each of two minor fold lines 20 and 21 respectively proceeding from opposite corners 19 of the end wall 1 are interconnected by way of a fold line 36, to each of which side flaps 37 are linked. The side flaps 37 and the closure flap 30 form the container closure. As can be seen in FIG. 7, that end of each of the side walls 2 and 3 which faces the side flaps 37 is interrupted by a fold line 38 forming blunted corner surfaces 39 in the erected state of the container. In this context the flap fold lines 36 constitute the fold lines which proceed at an angle from the minor fold lines, leading to the intersection points 10, 11 of the main fold lines 8, 9 with the container closure 5.

Figure 8:
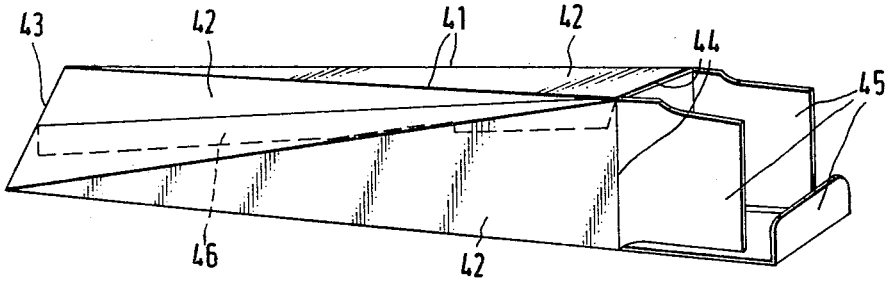
FIG. 8 is a perspective view, showing a container made from an inventive blank.

The container shown in FIG. 8 has several triangular sidewalls 42 connected by folds 41; the walls 42 are so arranged that they extend from two edges 43 at the narrow container end to form edges 4 bounding a quadratic container end. In FIG. 8 the quadratic container end has the conventional closure flaps 45. Since, however, the closure can be made in other ways as well, these flaps have been omitted in FIGS. 9, 10 and 12.

A glue flap or lug 46 is formed at one longitudinal edge of the blank and is to be adhered to the opposite edge 47. This involves overlapping of the two edges in question (see the broken lines in FIG. 8); the flap 46 extends over the edge 41 which extends at an acute angle to the edge 47. To avoid interference with the folding of this edge 41 the flap 46 is interrupted by a fold 48 (FIG. 9) corresponding to the fold 41 in the region of the edge 47 in such a manner that it coincides with the fold 41 when the flap 46 is glued to the edge 47.

At the location where the edge 48 approaches the flap 46, the flap 46 is cut out by a cut 49 forming an extension of edge 48, and by a cut 50 which extends at an angle thereto. This prevents those portions of the part 46' which is separated from flap 46 by edge 48, which are located close to the edge 48 from being pressed too strongly into the sidewall 42. The angle $\alpha$ formed between the cuts 49 and 50 is somewhat greater than 90°, so that the cut-out part can fall out without difficulties.

The edge 48 is preferably constituted by a perforation so that it offers as little resistance as possible to the folding step, but also does not tear during manufacture of the container.

Figure 9:
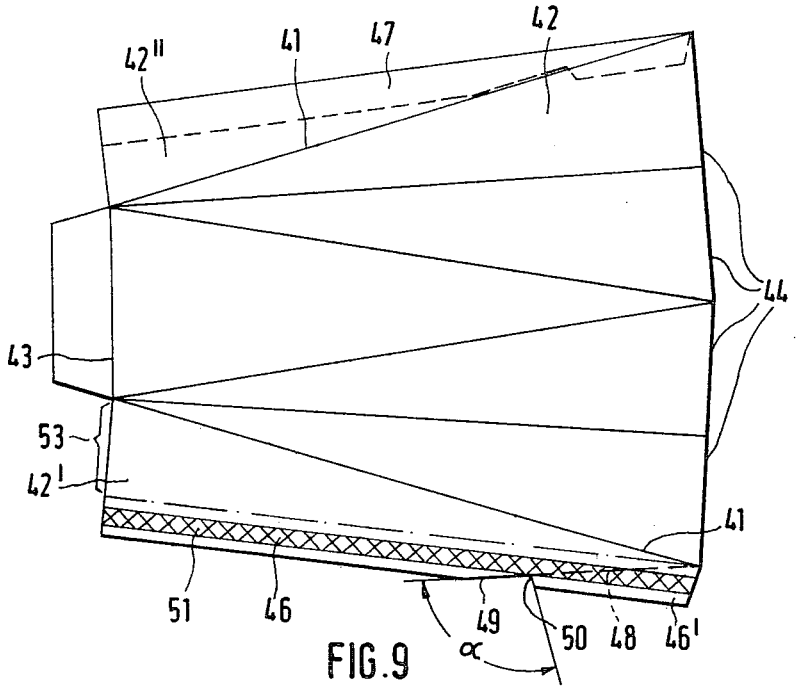
FIG. 9 shows the blank used to erect the container of FIG. 8.

In FIG. 9 the flap 46 follows in unfolded condition (see the chainline) a part 42' of one of the sidewalls 42 having its base at the edge 43, whereas the associated other part 42'' of the same wall 42 forms the opposite edge 47.

Figure 10:
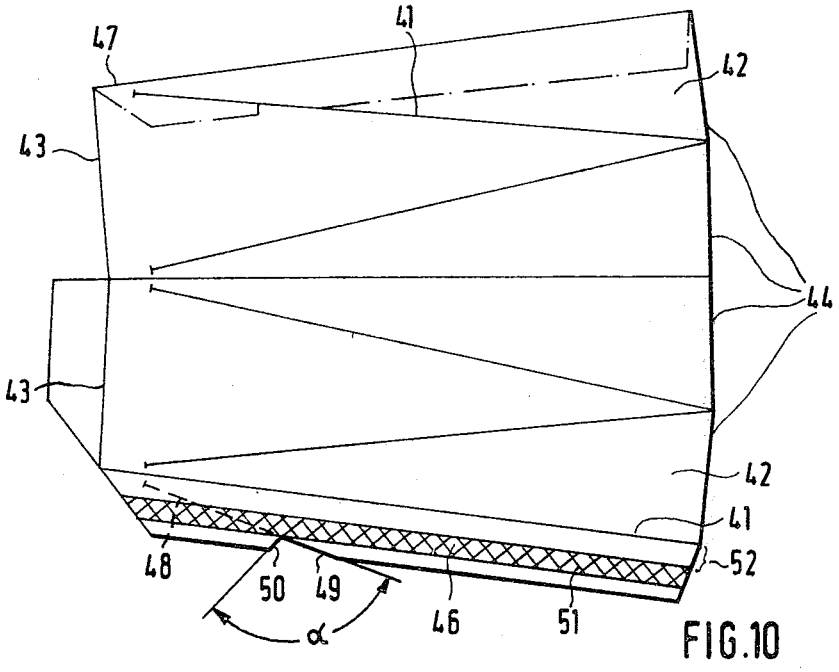
FIG. 10 is a view similar to FIG. 9, but showing a somewhat modified embodiment.

In FIG. 10 the flap 46 is hinged on one of the edges 41 of one of the sidewalls 42 and is to be glued to another of the sidewalls 42.

A comparison of the blanks in FIGS. 9 and 10 shows that the unfolded connection of flap 46 with a sidewall part 42' (i.e., the arrangement of the adhesive in the area of a sidewall 42 instead of along one of the edges 41) offers a significant advantage in the manufacture of the container: before the flap 46 is glued to the other edge 47, it must be folded about edge 41 so that subsequently the edge 47 can be placed onto it. This takes place in a machine through which the blank travels in direction lengthwise of the flap 46. Folding of the flap 46 is effected by a tool, e.g., a circulating belt, which engages the area located between the applied adhesive 51 (see the cross-hatched strip in FIGS. 9–10) and the adjacent edge 41. In FIG. 10 this area is a narrow strip 52 next to the adhesive strip, but which must be wide enough for engagement by the folding tool. It follows that the presence of strip 52 requires an additional expenditure of material.

By contrast, in FIG. 9 the tool engages a broad area 53 which tapers rightwards in FIG. 9 and which is present without requiring an additional expenditure of material, because it is essentially constituted by the sidewall part 42' which adjoins the flap 46 without folding.

Figure 11:
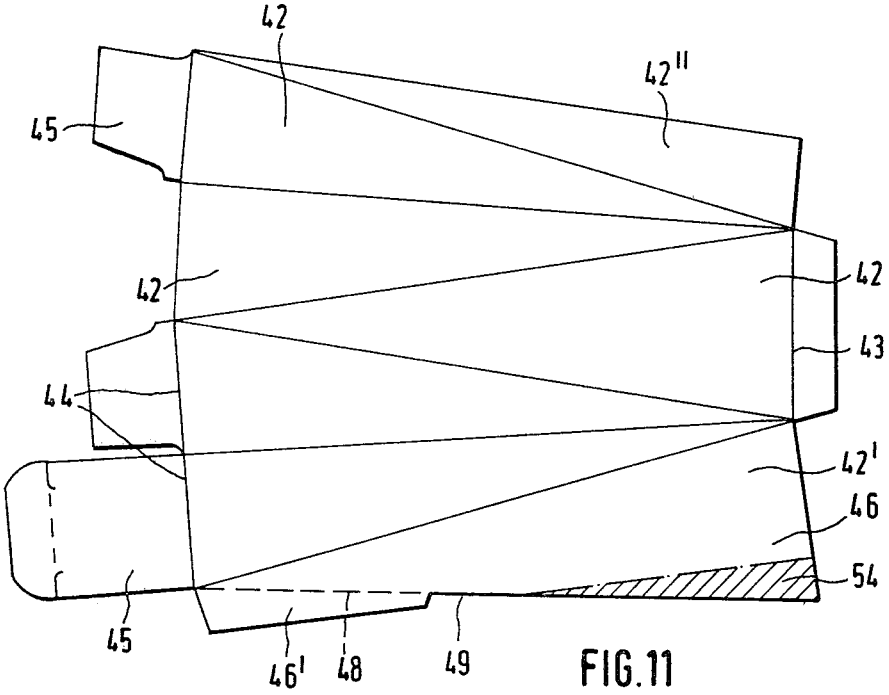
FIG. 11 is another view similar to FIG. 9, but of an embodiment with a wider bonding lug.

A blank similar to the one of FIG. 9 is shown in FIG. 11, except that the flap 46 is broadened by an adjacent triangular area 54 (shaded in FIG. 11) up to the total width of the sidewall 42 which is composed of the parts 42' and 42''. The outer edge of closure flap 45 is formed by a straightline extension of the edge 48 and the cut 49.

Figure 12:
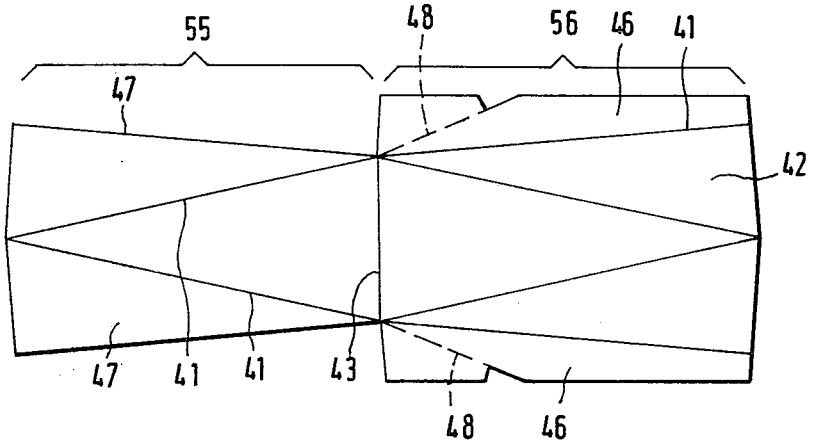
FIG. 12 is a view of still another blank embodiment having two bonding lugs.

The blank of FIG. 12 is composed of two parts 55 and 56 which are unitary with one another at the edges 43 forming the narrow container end. At opposite sides of the part 56 at the right in FIG. 12, the glue flaps 46 are hinged which are of the type discussed earlier and are to be glued to the opposite side edges of the other part 53. The advantage of this embodiment is that the blank can be folded in a simple manner about the goods to be packaged, e.g., a tube, and that the resulting container can then be closed by gluing at both ends. Despite the fact that this requires a double glue connection, there is no danger that folding of the edges 41 might be hindered or that parts of the flaps 46 might press into the sidewalls 42 from the inside of the container.

While the invention has been illustrated and described as embodied in a folded container, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. Container made from an integral blank of of pulpboard, cardboard, synthetic plastic or the like, comprising an elongate main body forming the side walls of the container and formed from the blank by connecting two opposite longitudinal flaps of the blank, a quadrangular end wall at one container end from which the side walls converge towards a narrow container closure at the opposite container end, one main folding line each extending from each of two diametrically opposite corners of the end wall rectilinearly towards a point of intersection at the narrow container closure, while minor foldlines proceed from the two other diametrically opposed corners of the end wall, and further fold lines extending from each of the minor fold lines at an angle to the minor fold lines and extending to the points of intersection of the main fold lines with the narrow container closure.

2. Container according to claim 1, wherein two minor fold lines proceed from each of the two diametrically opposite corners of the end wall and each of these is angularly deflected towards a fold line which proceeds in an outward direction towards the points of intersection of the main fold lines with the narrow container closure.

3. Container according to claim 2, wherein the fold lines which proceed to the intersection points of the main fold lines with the container closure are curved.

4. Container according to claim 1, wherein a minor fold line proceeds from each of the two diametrically opposite corners of the end wall, two further fold lines branching off from the end of each such minor fold line which in turn proceed to the two intersection points of the main fold lines with the container closure.

5. Container according to claim 1, wherein from each of the two diametrically opposite corners of the end wall two minor fold lines proceed, the ends of each of which are interconnected at the container end by a flap-forming fold line and connected to a narrow closure flap and from each of which three fold lines proceed between which there is formed a collapsible gusset which connects the closure flap to an adjoining container side wall.

6. Container according to claim 5, wherein the closure flap is foldably connected by way of a gluing flap to a second closure flap formed at the end of the two other minor fold lines.

7. Container according to claim 1, wherein from each of the two diametrically opposed corners of the end wall two minor fold lines proceed, the ends of two minor fold lines proceeding from a common corner being interconnected on the container by a flap-forming fold line and connected to a narrow closure flap, and wherein the ends of each of two minor fold lines which proceed from opposite corners of the end wall are interconnected by a fold line and connected to a side flap.

8. Container according to claim 1, wherein the main fold lines are at right angles to the two respectively adjoining edges of the end wall, each of the two edges of the end wall which are connected to the minor fold lines joining each other at an obtuse angle to one another and the end wall being a plane surface the diagonal of which has the same length as that of the narrow container closure.

9. Container according to claim 1, and having a glue flap, a fold line extending across said glue flap, and a cut-out formed in said glue flap by two mutually inclined cuts.

10. Container according to claim 9, wherein said cuts include between themselves an angle greater than 90°.

11. Container according to claim 9, said glue flap being proximal to a part of one of said sidewalls in unfolded condition, and another part of said one sidewall forming an edge portion to which said glue flap is bonded.

12. Container according to claim 9, said blank forming said container being composed of two parts which are integral with one another at an edge of the blank forming a narrow end of the container, one of said parts having two lateral sides each provided with one of said glue flaps and the other of said parts also having two sides to each of which one of said glue flaps is adhered.

13. Container according to claim 9, said fold line being a line of perforations.

14. Container according to claim 11, said one sidewall having a base line at which it is connected at a narrow end of said container with another similar sidewall.

15. Container according to claim 11, said glue flap merging into a triangular portion of said blank which broadens the glue flap to the total width of the sidewall being glued.

* * * * *